United States Patent [19]

Gates, Jr. et al.

[11] Patent Number: 4,459,134

[45] Date of Patent: Jul. 10, 1984

[54] OUTLET STRUCTURE FOR A DOWNFLOW GENERATOR

[75] Inventors: Walter C. Gates, Jr., Carmel; Roger J. Corbeels, Wappingers Falls, both of N.Y.

[73] Assignee: Texaco Inc., White Plains, N.Y.

[21] Appl. No.: 418,327

[22] Filed: Sep. 15, 1982

[51] Int. Cl.[3] ..... C10J 3/82

[52] U.S. Cl. ..... 48/77; 48/DIG. 2; 110/165 R

[58] Field of Search ..... 48/DIG. 2, 206, 63, 48/77, 76, 69; 55/319, 392, 394, 424, 458, 425, 426, 427; 110/165 R; 261/78 R; 422/147

[56] References Cited

U.S. PATENT DOCUMENTS 4,186,158 1/1980 Yamada ..... 261/78 R X

FOREIGN PATENT DOCUMENTS 1142214 11/1960 Netherlands ..... 110/165 R

*Primary Examiner*—Peter F. Kratz
*Assistant Examiner*—Joye L. Woodard
*Attorney, Agent, or Firm*—Robert A. Kulason; Robert Knox, Jr.; Henry C. Dearborn

[57] ABSTRACT

Outlet structure of a powdered coal gasification generator. The bottom of the generator has an outlet throat with cylindrical walls that extend beyond the base. And, the walls terminate in an oblique manner with a face shaped to promote flow of slag from the generator to a single point in order to minimize reentrainment of slag into the gasification products.

5 Claims, 4 Drawing Figures

OUTLET STRUCTURE FOR A DOWNFLOW GENERATOR

BACKGROUND OF THE INVENTION

1. Field of the Invention

This invention concerns structure relating to a generator used in coal gasification and the like where the solids being gasified are in finely divided form. More specifically, the invention deals with the structure of a outlet throat at the bottom of a generator being used with coal gasification of powdered coal.

2. Description of the Prior Art

In gasification procedures using finely divided solids that are being gasified, e.g., powdered coal, a continuing problem relates to the slag which is generated in the gasification process and which is in liquid form and tends to run down the walls of the generator and out through the throat of the outlet where it is reentrained into the gasification products at the bottom edge of the throat outlet, instead of remaining separated as is desired. The prior structure had a cylindrical outlet forming the throat of the generator and this throat would extend beyond the base of the generator so that there were cylindrical walls which then had a squared off face thereof.

It was discovered in connection with the use of droplets of water in air (used to simulate the flow pattern of a gasification generator) that most of the heavy phase of materials from a generator would flow on the walls of the outlet throat. The water running down the walls of such outlet tended to be distributed over the entire circumference of the outlet at the squared off face. And, as it dripped off therefrom, the tendency for reentrainment of the water was maximum.

Consequently, it is an object of this invention to provide improved structure of the outlet for a gasification generator (involving finely divided solid particles) which has liquid slag formed in the generator. The structure is such that the liquid slag may drip off from the edge of the outlet with a minimum of reentrainment into the gasification products.

SUMMARY OF THE INVENTION

Briefly, the invention relates to a downflow generator for use in coal gasification and the like wherein slag and ash particles are formed in the generator. It concerns outlet structure for said generator which structure comprises a reduced cross section throat for passing said gasification products including said slag and ash particles. The said slag and ash particles tend to separate from gasification products prior to and during passage through said throat and to be reentrained at the exit of said throat. The said throat has an oblique termination.

Again briefly, the invention relates to a downflow generator for use in finely divided coal gasification and the like, wherein slag forms in the generator. The said generator has a base with an outlet throat there through. The said throat has walls thereof extending beyond said generator base, and said walls terminate with a face around the free end thereof. In such a generator structure, the invention concerns the improvement which comprises the said termination being oblique relative to the axis of said throat.

Again briefly, the invention is in connection with a downflow generator for use in finely divided coal gasification and the like, wherein slag forms in the generator. The said generator has a base with an outlet throat there through, and said throat has cylindrical walls extending beyond said generator base. The said walls terminate with a face around the free end thereof. The improvement comprises an oblique termination of said cylindrical walls, at an angle of about 30° relative to the axis of said throat. The said face is shaped to promote flow of said slag to a single point in order to minimize reentrainment into said gasification products. Said shaped face comprises a planar surface having said angle of about 30° relative to the axis of said throat. The shaped face also has a twisted flat surface joining said planar surface at its ends and maintaining an angle less than 90° for assisting deflection of said slag onto said shaped face. The improvement also comprises fluting on the inside surface of said throat for directing said slag toward the lowest point on said shaped face.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENT

Figure 1:
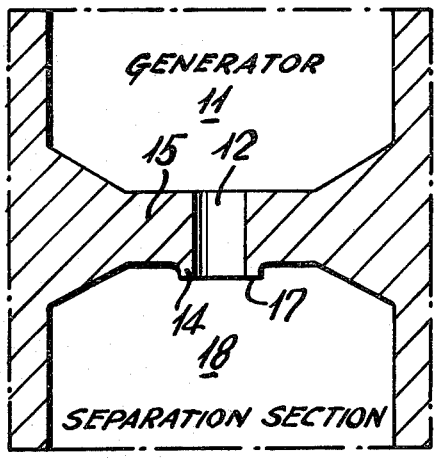
Fig. 1. (PRIOR ART)
FIG. 1 is a schematic cross sectional indication of prior art structure illustrating a generator outlet of the type to which this invention applies.

FIG. 1 illustrates in a schematic manner a generator 11 of the type which is for use in coal gasification or the like, where a finely divided solid is being gasified. Such gasification procedure forms slag and ash particles which are heavy phase products that are discharged with the gasification products through a reduced cross section throat 12. Such throat has cylindrical walls 14 which extend beyond a base 15 of the generator 11. The walls 14 have a squared off annular face 17. And, it has been found that this is where the liquid slag (not shown) that separates as the heavy phase products, tends to drip off after running down the walls of the throat 12. Gasification products, of course go through the throat into a separation section 18 beneath the generator 11.

It was discovered by using simulation tests with water droplets, that the heavy phase liquid tends to run down the walls of a throat like the throat 12 and drip off all the way around at the intersection of the face 17 with the throat 12. Consequently, the tendency for the liquid to be reentrained in the gaseous, products, was high.

However, in accordance with this invention it was discovered that by providing improved structure at the outlet of the throat, the slag liquids may be caused to drip off at a single point which greatly minimizes the reentrainment. And, an embodiment of the improved structure for accomplishing the foregoing is illustrated in FIGS. 2, 3 and 4.

Figure 2:
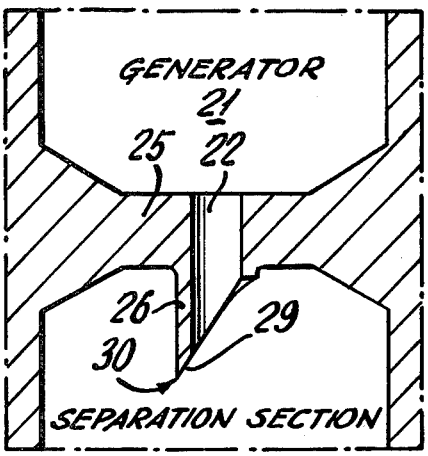
FIG. 2 is another schematic cross sectional showing of a generator outlet including structure of the outlet throat according to this invention.

Thus, with reference to FIG. 2 it will be noted that there is schematically illustrated a generator 21 which is for use in gasification of finely divided materials such as coal and the like. Such gasification forms slag (not shown) in the generator 21 as part of the heavy phase products, and such slag becomes liquid and runs down through an outlet throat 22 which extends through a base 25 of the generator 21. The throat 22 has cylindrical walls 26 which extend down beyond the base 25 of the generator 21. Walls 26 terminate with an annular face 29 that is at an oblique angle relative to the axis of the throat 22. The face 29 is so shaped as to promote flow of slag to a single lowest point 30 which will minimize the reentrainment of the slag with the gasification products.

Figure 3:
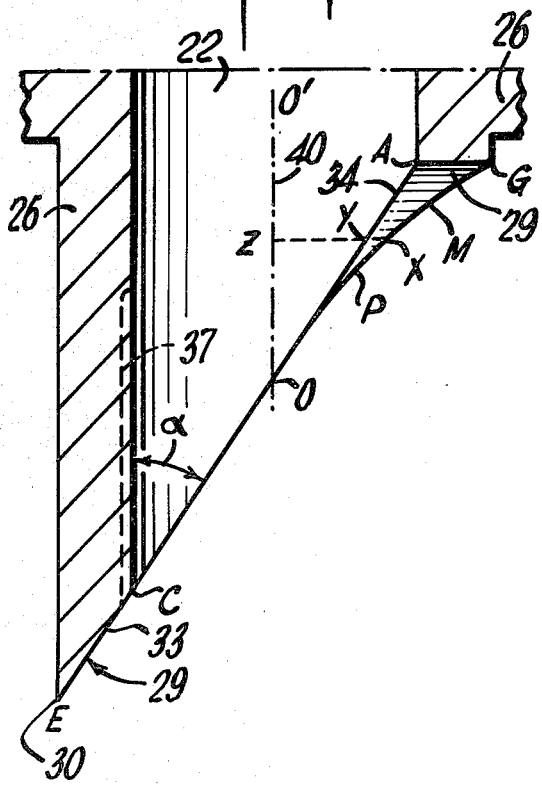
FIG. 3 is an enlarged detail cross sectional showing of the outlet throat structure according to this invention taken along the line 3—3 on FIG. 4.
Figure 4:
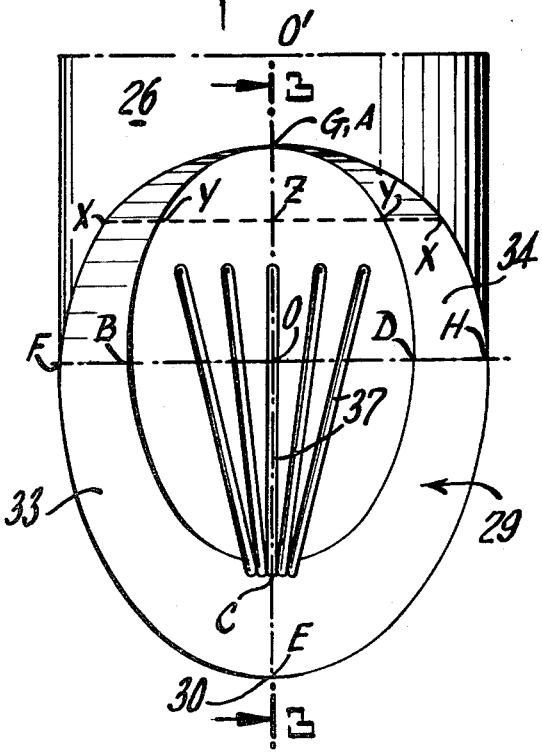
FIG. 4 is an enlarged elevation of the detail illustrated in FIG. 3 but taken at right angles thereto.

The structure of the face 29 of the outlet throat 22 is more clearly illustrated in the enlarged showings of FIGS. 3 and 4. Thus, the face 29 includes a planar surface 33 on the lower portion thereof. It has an angle of about 30° relative to the axis (indicated by center line 0–0') of the throat 22. There is an upper portion 34 of the surface 29 which portion 34 is formed into a twisted flat surface that joins the planar surface 33 at its ends. A geometric description of the shaped face 29 will be more fully indicated below.

In addition to the face 29 being shaped for obtaining the desired promotion of slag flow to the single point 30 at the lowest end of the throat, the structure may include a plurality of converging flutes or grooves 37 that are cut into the inside surface at the longest end in order to direct slag flow toward the low point 30.

With reference to FIGS. 3 and 4 and the letter designations at the various points on the surface of face 29 which are indicated thereon, a geometric description may be delineated. Thus, consider that the throat is a circular cylinder and it has axis 0–0' which is indicated by a dashed line 40. The curve ABCD is formed by an intersection of the inside surface of the throat 22 and a plane that is inclined to the axis 40 by an angle $\alpha$ indicated in FIG. 3. Then, a curve FEH is formed by the intersection of that same plane with the outside surface of the cylindrical walls 26, and the planar surface 33 is outlined by the letters BCDHEF. Thus, planar surface 33 has two elliptical edges BCD and HEF, and two linear edges BF and DH.

On the upper portion of the face 29, the curves FPXG and HXG are formed by the intersection of the outside surface of the walls 26 with a line XYZ. The line XYZ is taken such that Z lies on the axis 40 and Y lies on curve on ABCD while XYZ is perpendicular to the axis 40. The surface thus delineated is the upper surface 34 which may be described as a twisted flat surface that joins the planar surface 33 at its linear edges BF and DH.

It is to be noted that a particular benefit of the form of the shaped face 29 is that deflections of less than 90° are presented to the fluid running down the surface of the throat 22. This means that the liquid slag will tend to adhere to and run down the face 29 including the portions 34 and 33 until it reaches the lowest point 30 (E) where it will drip off with a minimum of reentrainment with the gasification products.

It may be noted that the flutes 37 will aid in channeling the liquid slag as it comes down the longer side of the throat 22. It will be directed toward the lower part of the face 33 so as to help concentrate the flow of slag.

While a particular embodiment of the invention has been described above in considerable detail in accordance with the applicable statutes, this is not to be taken as in any way limiting the invention but merely as being descriptive thereof.

We claim:

1. In a downflow generator for use in finely divided coal gasification and the like wherein slag forms in said generator, said generator having a solid base extending across the bottom thereof with a vertical outlet throat extending there through for passage of gas products, said throat having cylindrical walls thereof extending beyond said generator base, said walls terminating with a face around the free end thereof, the improvement comprising said walls terminating so as to form an annular face which is oblique relative to the axis of said throat and shaped to promote flow of said slag to a single point of said wall termination to minimize reentrainment of said slag into the gas products.

2. In a downflow generator according to claim 1, wherein said oblique termination is at an angle of about thirty degrees relative to the axis of said throat.

3. In a downflow generator according to claim 2, wherein said shaped face comprises a planar surface having said angle of about thirty degrees relative to the axis of said throat, and said shaped face also comprises a twisted flat surface joining said planar surface at its ends and maintaining an angle less than ninety degrees for deflection of said slag onto said shaped face.

4. In a downflow generator according to claim 3, wherein said improvement further comprises fluting on the inside surface of said throat for directing said slag toward the lowest point on said shaped face.

5. In a downflow generator for use in finely divided coal gasification and the like wherein slag forms in said generator, said generator having a base with an outlet throat therethrough, said throat having cylindrical walls extending beyond said generator base, said walls terminating with a face around the free end thereof, the improvement comprising an oblique termination of said cylindrical walls at an angle of about thirty degrees relative to the axis of said throat, said face being shaped to promote flow of said slag to a single point for minimizing reentrainment into said gasification products, said shaped face comprising a planar surface having said angle of about thirty degrees relative to the axis of said throat, and a twisted flat surface joining said planar surface at its ends and maintaining an angle less than ninety degrees for deflection of said slag onto said shaped face, and fluting on the inside surface of said throat for directing said slag toward the lowest point on said shaped face.

* * * * *